United States Patent [19]

Glassman

[11] 4,120,252

[45] Oct. 17, 1978

[54] HEMMER ATTACHMENT FOR A SEWING MACHINE

[75] Inventor: Aaron Glassman, Scranton, Pa.

[73] Assignee: Pennsylvania Sewing Research Corp., Dunmore, Pa.

[21] Appl. No.: 831,190

[22] Filed: Sep. 7, 1977

[51] Int. Cl.[2] ..... D05B 35/04

[52] U.S. Cl. ..... 112/143

[58] Field of Search ..... 112/141, 136, 143, 144, 112/147

[56] References Cited

U.S. PATENT DOCUMENTS

| | | | |
|---|---|---|---|
| 80,558 | 4/1868 | Morrison | 112/141 X |
| 1,117,890 | 11/1914 | Nicholson | 112/143 |
| 1,153,459 | 9/1915 | Stafford | 112/143 |
| 2,210,647 | 8/1940 | Ackerman | 112/143 |
| 3,752,100 | 8/1973 | Sharp | 112/143 |

*Primary Examiner*—Werner H. Schroeder
*Assistant Examiner*—Moshe I. Cohen

[57] ABSTRACT

Hemmer attachment comprises guiding walls arranged to fold a margin of a body of material to form a hem. The guiding walls include a stationary outer portion and a movable inner portion mating with the outer portion. The device includes means for translating the inner portion away from its mating position with the outer portion and then rotating the inner portion away from the outer portion.

7 Claims, 4 Drawing Figures

HEMMER ATTACHMENT FOR A SEWING MACHINE

BACKGROUND OF THE INVENTION

This invention relates to a hemmer attachment for use with a sewing machine.

A hemmer attachment comprises guiding walls, usually scroll-like, arranged to fold a margin of a body of fabric or material to form a hem, which is then sewn on a sewing machine. The margin of the body of material is usually circular; for example, the bottom of a closed ladies' dress, or a closed sleeve of a blouse, or a closed cuff on a pair of pants. When material is folded and sewn into a hem on such a closed, circular path, the material passing through the hemmer returns to its starting point; that is, it catches up with itself. At that point, the material is trapped in the hemmer. A device which is capable of releasing the hemmed material is known as a "split hemmer" in the art. In a split hemmer, the guiding walls comprise a stationary outer portion and a movable inner portion which is normally mated with the outer portion. When it is desired to release the hemmed material, the inner portion is either slid (translated) or rotated away from the stationary outer portion, permitting the hemmed material to be removed. In either type of split hemmer, the clearances are such as to make the removal of the hemmed material awkward.

SUMMARY OF THE INVENTION

The hemmer attachment is of the split type having guiding walls including a stationary outer portion and a movable inner portion normally mating with the outer portion as in the prior art. Unlike the prior art, the novel hemmer attachment includes means first for sliding or translating the inner portion out of its mating position with the outer portion, and then for rotating the inner portion away from the outer portion. By first sliding and then rotating the inner portion, the hemmed material is easily and conveniently released from the hemmer.

DETAILED DESCRIPTION OF THE PREFERRED EMBODIMENT

Figure 1:
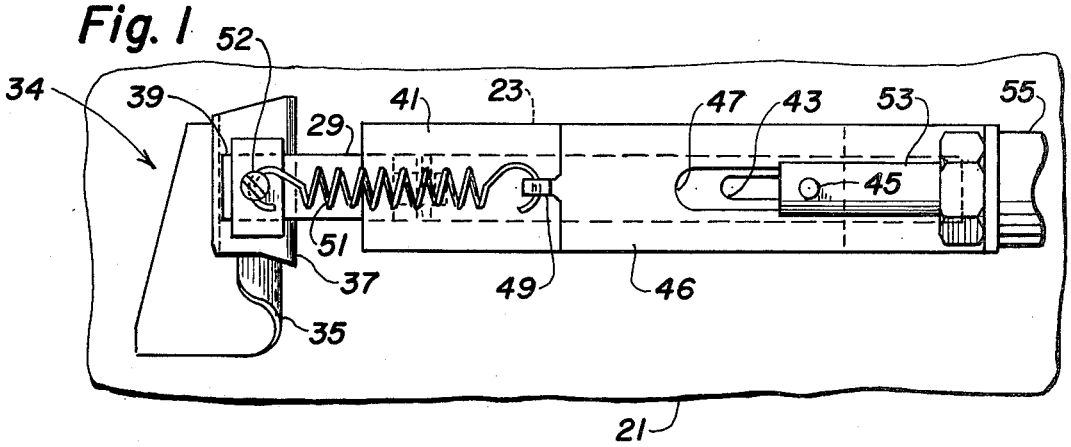
FIGS. 1 and 2 are plan and side views respectively of the preferred embodiment of the invention showing the two-portion guiding walls in their normally mating position.
Figure 2:
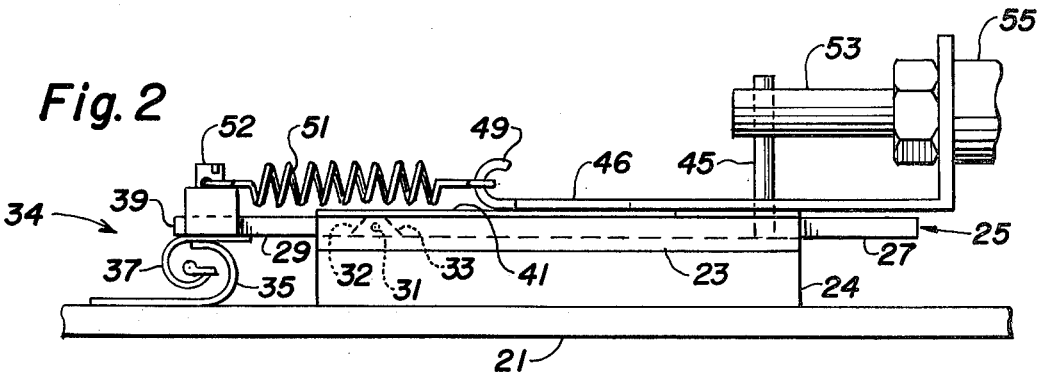

Referring to FIGS. 1 and 2, the preferred hemmer attachement is mounted on a support 21 shown broken away. The support 21 may be, for example, the portion of the sewing table on the feed side of the sewing needle of a sewing machine. The hemmer includes a slide holder 23 mounted on a spacer 24. A sliding member 25 in a channel of the holder 23 includes a larger driving part 27 and a smaller driven part 29 which are connected together in tandem with a pin 31. The parts 27 and 29 have abutting surfaces 32 and 33 which are so angled with respect to the major surfaces of the sliding member 25 as to permit the driven part 29 to rotate around the pin 31 when the driven part 29 is out of the holder 23.

The guiding walls 34 of the hemmer attachment include a stationary outer portion 35 mounted on the support 21 and a movable inner portion 37 mounted near the extended end 39 of the driven part 29 of the sliding member 25. As shown in FIGS. 1 and 2, the outer and inner portions are mated and provide guiding walls for forming a complete hem just prior to stitching.

A cover plate 41 holds the sliding member 25 in the holder 23. The cover plate 41 has an elongated first slot 43 therethrough. A drive post 45 is fixedly attached to the driving part 27 of the sliding member 25. The post 45 extends through the first slot 43 which is shaped to permit the post 45 and sliding member 25 to move to at least two positions. A hook plate 46 having a second elongated slot 47 therein is attached to the cover plate 41. The hook plate has an upstanding hook 49 at one end. A tensioned spring 51 is connected to the hook 49 and an anchor 52 near the extended end 39 of the driven part 29.

The sliding member 25 is translated (slid) by a force applied to the post 45 towards the left as shown in FIGS. 1 and 2 and then returned to the initial position shown. The force may be applied by hand, or pneumatically, or hydraulically or electrically (as with a solenoid). As shown in FIGS. 1 and 2, the force is applied pneumatically with a ram 53 from a cylinder 55 (shown broken away).

Figure 3:
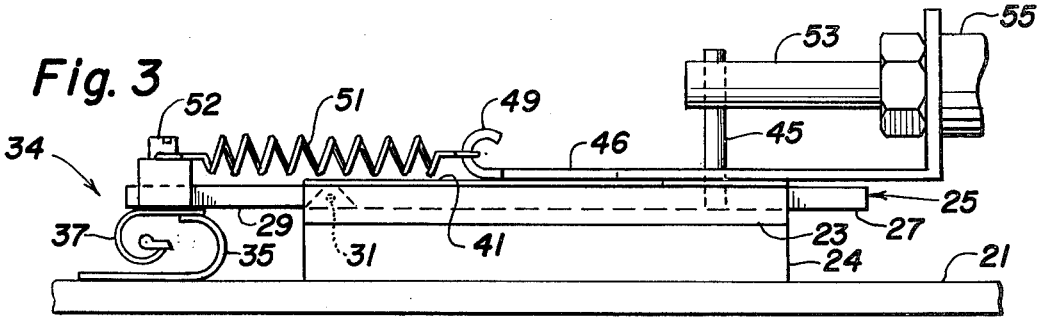
FIG. 3 is a side view of the preferred embodiment after the inner portion of the guiding walls has been translated out of its normally mating position with the outer portion.
Figure 4:
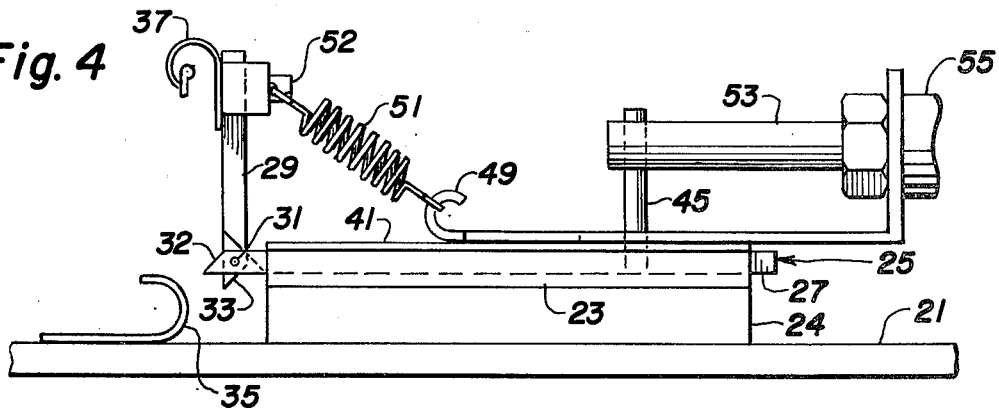
FIG. 4 is a side view of the preferred embodiment after the inner portion of the guiding walls has been translated and then rotated away from the outer portion.

In operation, fabric or material is fed through the guiding walls 34 which are in mating position as shown in FIG. 2. When the hemming is complete, the pneumatic cylinder 55 is actuated, moving the ram 53, the post 45 and the sliding member 25 to the left. As shown in FIG. 3, the inner and outer portions 35 and 37 of the guiding walls 34 open by translation. Then, when the abutting surfaces 32 and 33 are beyond the slide holder 23, the force from the spring 51 causes the driven part 29 to rotate upward as shown in FIG. 4. The inner and outer portions 37 and 35 are thereby clear of one another and the hemmed material is easily removed. The hemmer is returned to its mating position by reversing the sequence; that is, actuating the cylinder 55 to return the ram 53 to its initial position. The next body of material may be positioned in the hemmer prior to or after the hemmer has been returned to its mating position.

What is claimed is:

1. A hemmer attachment for a sewing machine comprising guiding walls arranged to fold a margin of a body of material to form a hem, said walls comprising a stationary outer portion and a movable inner portion mating with said outer portion, and means attached to said inner portion for translating said inner portion away from its mating position with said outer portion and then rotating said inner portion away from its outer portion, characterized in that said translating-and-rotating means comprise (a) a holder for a sliding member;

(b) a sliding member in said holder, said sliding member comprising (i) a driving part and (ii) a driven part connected in tandem with a pin to said driving part, said inner portion of said walls being attached to said driven member;

(c) connection means attached to said driving part for positioning said sliding member in one of at least two different positions with respect to said holder;

whereby, in one position, said pin and a portion of said driven part are inside said holder and, in the other position, said pin and said driven part are outside said holder;

(d) and means for rotating said driven part about said pin when said sliding member is moved from said one position to said other position.

2. The hemmer attachment defined in claim 1 wherein said connection means is adapted for manual positioning of said sliding member.

3. The hemmer attachment defined in claim 1 wherein said connection means is adapted for pneumatic positioning of said sliding member.

4. The hemmer attachment defined in claim 1 wherein said connection means is adapted for hydraulic positioning of said sliding member.

5. The hemmer attachment defined in claim 1 wherein said connection meams is adapted for electrical positioning of said sliding member.

6. The hemmer attachment defined in claim 1 comprising guiding walls arranged to fold a margin of a body of material to form a hem thereon, said walls comprising a stationary outer portion adapted to be mounted in a stationary position with respect to the sewing platform of said machine, and a movable inner portion normally mating with said outer portion, and means attached to said inner portion for sliding said inner portion away from said mating position with said outer portion and then rotating said inner portion away from said outer portion, whereby to disenage said body of material from said guiding walls.

7. The hemmer attachment defined in claim 1 wherein said rotating means is a spring mounted between said driven part and said holder.

* * * * *